United States Patent [19]

Thometz et al.

[11] Patent Number: 4,901,804

[45] Date of Patent: Feb. 20, 1990

[54] ARTICULATED DOWNHOLE SURVEYING INSTRUMENT ASSEMBLY

[75] Inventors: Theodore G. Thometz, Salt Lake City; Charles D. Barron, Sandy, both of Utah

[73] Assignee: Eastman Christensen Company, Salt Lake City, Utah

[21] Appl. No.: 232,471

[22] Filed: Aug. 15, 1988

[51] Int. Cl.[4] ..... E21B 47/00

[52] U.S. Cl. ..... 175/40; 175/45; 166/66; 166/250; 324/355; 324/356; 324/369

[58] Field of Search ..... 175/40, 45, 50; 166/250, 381, 324, 385, 64, 65.1, 66; 33/304, 309, 310, 311, 314; 73/151; 324/355, 356, 366, 369, 219–221, 323, 346

[56] References Cited

U.S. PATENT DOCUMENTS

| | | | |
|---|---|---|---|
| 3,052,309 | 9/1962 | Eastman | 175/45 |
| 3,964,553 | 6/1976 | Basham et al. | 166/66 X |
| 4,024,913 | 5/1977 | Grable | 166/72 |
| 4,047,306 | 9/1977 | Otte et al. | 33/314 |
| 4,349,072 | 9/1982 | Escaron et al. | 166/65.1 X |
| 4,484,628 | 11/1984 | Lanmon, II | 166/65.1 X |
| 4,524,324 | 6/1985 | Dickinson, III | 33/304 X |
| 4,529,939 | 7/1985 | Kuckes | 166/250 X |
| 4,666,300 | 5/1987 | Zollman et al. | 33/304 X |
| 4,729,429 | 3/1988 | Wittrisch | 166/65.1 |

*Primary Examiner*—Bruce M. Kisliuk

*Attorney, Agent, or Firm*—Joseph A. Walkowski

[57] ABSTRACT

An articulated downhole surveying instrument and method for measuring parameters of a wellbore includes one or more laterally flexible coupling sections. The laterally flexible coupling sections are rigid in axial tension and axial compression, and are smaller in cross-section than the surveying instrument housing. A separate housing is used for each component of the surveying instrument, and each component housing is interconnected with the laterally flexible coupling. One or more flexible spacer bars are also provided. The spacer bars and coupling sections enable the assembly to be passed through a short-radius angle wellbore with greatly reduced risk of sticking or hanging up.

16 Claims, 4 Drawing Sheets

ARTICULATED DOWNHOLE SURVEYING INSTRUMENT ASSEMBLY

BACKGROUND OF THE INVENTION

This invention relates, generally, to downhole measuring instrumentation, and more specifically to flexible downhole instrumentation assemblies, such as may be used to negotiate short-radius angled wellbores. In one particularly preferred embodiment, the invention is in the form of a flexible downhole surveying instrument assembly for short-radius angle wellbores wherein the instrumentation components of the assembly are connected with a laterally flexible coupling.

In many applications, it would be desirable to have downhole instrumentation assemblies which will negotiate inclined wellbores, including short-radius bends, but which still have longitudinal rigidity. The need for such flexible instrumentation assemblies may encompass many types of instrumentation, including well logging apparatus and survey instrumentation. The need for this type of flexible instrumentation may perhaps be most severely felt with respect to well survey equipment used to determine the path of a well as it is drilled.

In both straight and directionally drilled holes, the position of the wellbore beneath the surface must be determined at various times and locations as the well is being drilled. This requires the use of surveying instruments that are able to measure the hole inclination and hole direction at various depths along the course of the well. The position of the wellbore relative to the surface location is then calculated from the cumulative survey results.

The surveying instrument records the direction and angle of the wellbore at a predetermined depth. To do this, the instrument is typically located near the bottom of the drill string in the wellbore.

Another use of the survey instrument is to measure and record the orientation of the drilling assembly relative to either magnetic north or to the high side of the wellbore. By holding the survey instrument in a desired position and taking surveys with the instrument at approximate intervals of 20 or 30 feet, for example, during the initial pilot bore (or first drill string used to guide larger drill pipe), the path of the short-radius bend in the wellbore may be calculated and plotted by inclination angle change and measured depth.

In one conventional type of survey assembly, a camera is incorporated into a surveying instrument assembly to record the wellbore inclination and direction. The camera photographs the inclination and direction measurements when the surveying instrument is in a stationary position near the bottom of the drill string. This type of downhole surveying instrument is known as the "single shot". Single shot surveys may be run at any depth. The interval is usually determined by the hole inclination build rate at the time the wellbore is being drilled. Magnetic multi-shot survey instruments are usually run at the completion of the wellbore prior to setting casing.

A single-shot or multi-shot downhole surveying assembly generally includes a sensitive angle measuring unit that indicates the magnetic direction and inclination of the wellbore (a compass and inclinometer), a camera unit with a lamp assembly to photograph the position of the angle measuring unit, and a timer or motion sensitive device that activates the camera. The surveying instrument assembly also may include a battery pack that provides the power required to operate the camera, timer and lights. The timer or motion sensing device is used to close an electrical circuit and activate the camera at the correct moment; for example, when the compass and inclinometer have reached the bottom of the wellbore. Typically, the timer can be set on the surface to allow sufficient time for the assembly to be run in the hole and landed in position before the camera operates. After the camera operates and the instrument is recovered at the surface, the survey results may be read directly off the developed film.

Multi-shot survey instruments are used to measure the trajectory of the wellbore. A multi-shot instrument is capable of taking a series of photographs at pre-set time intervals (e.g., every 30 seconds). Solid state sensors also have been employed with the multi-shot to measure the position of the wellbore. This type of instrument is often referred to as an electronic multi-shot. The results are stored in the tool's memory. Once the tool is recovered at the surface, the surveys can be obtained by linking the tool to a surface computer.

More recently, measurement systems which continuously monitor the inclination and direction of the wellbore have been used, which reduces the downtime required to run single-shot or multi-shot surveys. Continuous monitoring also gives the directional driller the ability to assess the effects of changing drilling parameters on borehole inclination, azimuth, and bottom hole assembly orientation. To survey the borehole position continuously while drilling typically requires the use of instruments that contain accelerometers and magnetometers. Accelerometers measure components of the earth's gravitational field, while magnetometers measure components of its magnetic field. By measuring the vector components of earth gravitational and magnetic field, the inclination and azimuth of the wellbore can be determined.

With each of these types of surveying instrumentation, it is fundamental to the survey operation that the instrumentation negotiate through or along the well path. Generally, the surveying instruments are contained in a cylindrical protective housing, which slides down either the wellbore or inside the drillstring assembly.

Short radius drilling typically establishes wellbores with increasing inclinations at rates of between 1.5° to 3° per foot and produces wellbore angle radii of between 20 and 40 feet. For example, the geometry of a well can change from vertical to horizontal in as little as 30 to 60 drilled feet. Short radius wellbores are often drilled with a drilling assembly consisting of a drill bit, rotating bit sub, a non-rotating curved drill guide, a rotating clutch sub and a flexible rotating drill pipe above. A flexible rotating drive shaft internal to the curved drill guide transmits the rotating torque from the rotating clutch sub to the rotating bit sub. An alternate drilling assembly may consist of a drill bit and mud motor with a bent housing.

Often, problems arise when attempting to lower or raise a surveying instrument assembly through this short-radius drill string assembly. Sinker bars often are used to add weight and help the surveying instrument travel through the mud and through the short radius to reach the landing plate at the bottom of the drill string assembly. However, even with sinker bars there is a risk of the instrument assembly sticking or hanging up at a short-radius curve in the drill string. Sinker bars generally are threadably coupled to one another, and to one or more spacer bars. Spacer bars are used to position the compass and camera assembly at the optimum point within the wellbore, typically to reduce the risk of magnetic interference.

Ideally, the surveying instrument housing, sinker bars, and spacer bars are slidable within the wellbore However, in wells with short-radius bends in the wellbore these instruments frequently stick and hang up at the outer cylindrical surface at various locations in the drill string. The cylindrical housing or canister for the surveying instrument, as well as the cylindrical sinker bars and spacer bars, while having enough lateral flexibility to pass a medium or long-radius angle wellbore, are typically too stiff and too large to traverse short-radius wellbores. Because of the cross-section or diameter of the housing, conventional housings simply are too stiff and fit too snugly within the bore of the drill string section that includes the drill guide and flexible joints to allow the instrument assembly to traverse the drill string. The present invention solves these needs and problems.

SUMMARY OF THE INVENTION

The present invention provides a flexible downhole instrumentation assembly and method which may be utilized with, among other devices, surveying instrumentation for passing through and measuring parameters of a short-radius angle wellbore. The assembly includes a laterally flexible coupling having a reduced cross-section for interconnecting at least two components of the assembly. For example, in the preferred embodiment of a survey instrument described herein, the flexible coupling interconnects a remotely actuatable power source enclosed in a first cylindrical housing, and a measuring and recording device enclosed in a second cylindrical housing. Each housing is slidably receivable within the inside diameter of the drill string, while the laterally flexible coupling itself has a reduced diameter cross-section to prevent the risk of sticking or hang-up in the inside diameter of the drill string. In the preferred embodiment described herein, the instrumentation assembly of the present invention is described in terms of a single shot downhole surveying instrument. It should be clearly recognized that the present invention may be in the forms of not only various types of surveying instrumentation, but also of other types of downhole instrumentation, such as well logging apparatus.

The laterally flexible coupling is rigid and stiff in axial tension or axial compression, while being sufficiently flexible to pass through the drill string inside diameter existing in the short-radius angle wellbores. Preferably, each coupling includes an intermediate portion with a reduced diameter cross-section and an enlarged threaded end section slidably receivable in the drill string inside diameter. In one embodiment of the coupling, it includes conductive means for providing electrical communication between instrumentation housings. In the described embodiment the laterally flexible coupling facilitates an electrical circuit between the power source and the measuring and recording device. In this preferred embodiment, the coupling includes a conductive rod within the connector, a telescoping end piece coupled to each end of the rod, and a conductive coupling body.

BRIEF DESCRIPTION OF THE DRAWING

FIG. 6 is a side view, partially in vertical section, of flexible spacer bars according to the present invention.

DETAILED DESCRIPTION F THE PREFERRED EMBODIMENT

Figures 1, 4:
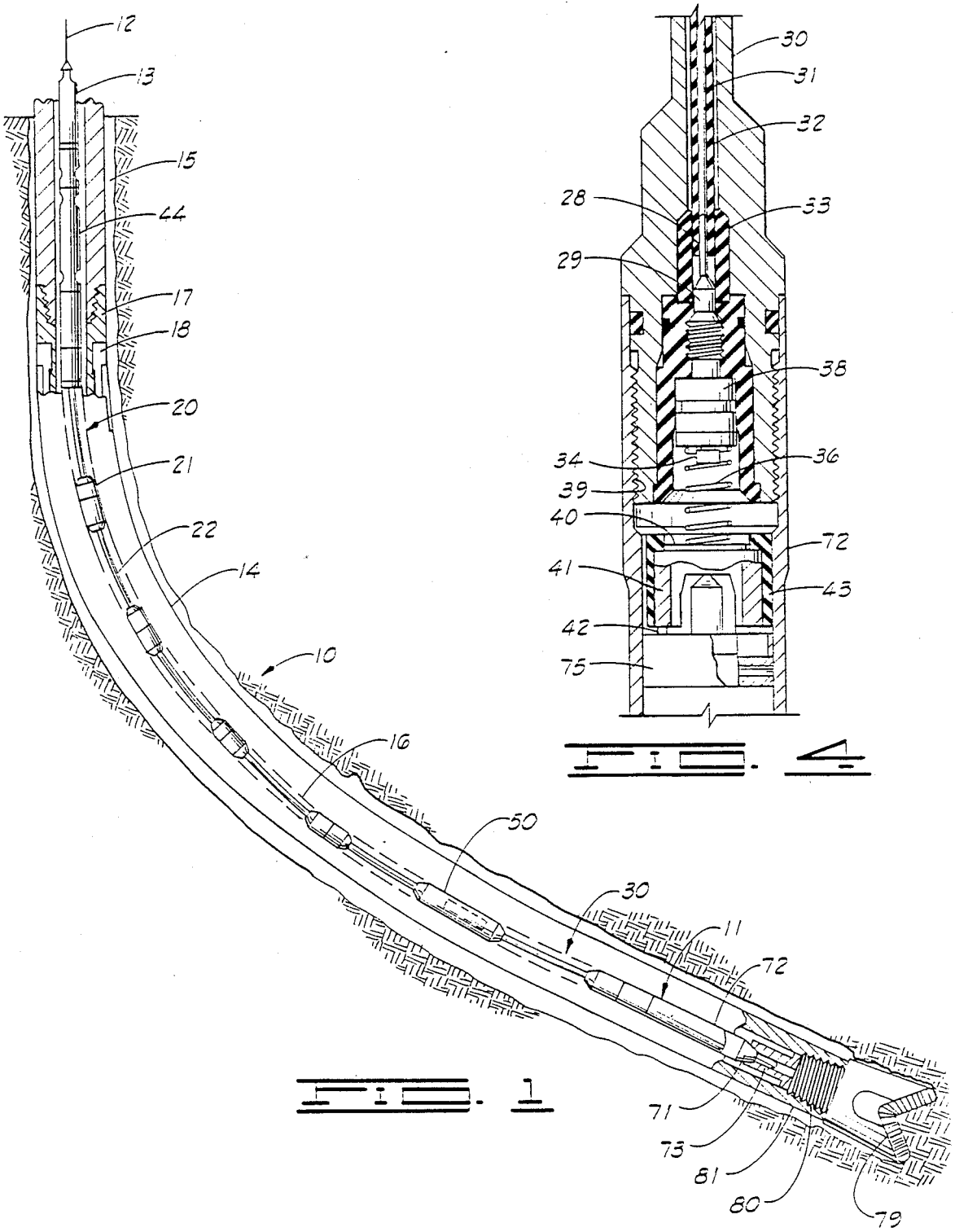
FIG. 1 is a section view of a short-radius angle drill string showing a flexible downhole surveying instrument assembly in accordance with the present invention.
FIG. 4 is a section view of a portion of the surveying instrument assembly of FIG. 3, showing the electrical coupling between the flexible connector and the surveying instrument housing.

A preferred embodiment of the present invention may be used with a curved drill guide, which is shown in FIG. 1 as short-radius drilling assembly 10. The short-radius assembly 10 typically includes a plurality of non-rotating sleeves or flexible drill pipe 14. Each of these non-rotating drill pipe sections 14 are typically stressed into the designed radius of curvature. The non-rotating sections are then coupled to a rotating drive pipe 15 by clutch 18 and rotating clutch sub 17, as is known in the art. Also shown in FIG. 1, drill bit 79 is coupled to the threaded section 80 of rotating bit sub 81. A flexible drive shaft and flexible liner 16 (typically a PVC liner) is provided in the non-rotating drill pipe sections. The configuration of the curved drill pipe and bit is well known to those skilled in the art and is not essential to an understanding of the present invention, so will not be described in further detail.

Still referring to FIG. 1, a flexible surveying instrument assembly 11 is shown disposed within short radius drilling assembly 10. The flexible surveying instrument assembly 11 is slidable within the flexible liner 16. As shown in FIG. 1 and in FIGS. 2 and 3, the instrument assembly 11 is sized to slidably fit and maintain desired orientation within the flexible liner 16. The surveying instrument assembly 11 includes a battery and timer housing 50 and a camera and angle unit housing 72. The angle unit includes a compass and inclinometer (not shown). Battery and timer housing 50 is coupled to the camera and angle unit housing 72 with flexible conductor assembly 30, which provides lateral flexibility in short-radius wellbores. The surveying instrument assembly includes landing nose assembly 71 which is connected to the lower end of the camera and angle unit housing 72. The landing nose assembly 71 aligns the assembly in landing plate 73 when the surveying instrument assembly reaches the bottom of the interior of the drill string.

Typically, the surveying instrument assembly 11 is lowered and raised in the wellbore by a wireline 12 which is tied to wireline sub 13. A sinker bar 44, generally of brass, is coupled to the wireline sub. Additional sinker bars may be utilized to provide sufficient weight for the surveying instrument assembly 11 to traverse the wellbore. Sinker bars 44 may be coupled to spacer bars 20. According to the present invention, each spacer bar 20 includes an upset end section 21 and a laterally flexible intermediate portion 22 to bend around the short-radius angles of the drill pipe, yet provide sufficient rigidity in response to axial tension or compression as the assembly is raised or lowered. Preferably, the spacer bar 20 is composed of aluminum or an aluminum alloy, such as 6061 alloy. The diameter of the intermediate portion 22 of the laterally flexible spacer bar is significantly less than the diameter of the end section. In a preferred embodiment, adapted to fit within a one and one-half inch diameter liner, each end section has a diameter of approximately one inch and intermediate portion has a diameter of approximately one-half inch, and spacer bar 20 is approximately six feet in total length, of which approximately five and one-half feet comprise intermediate portion 22.

Figure 2:
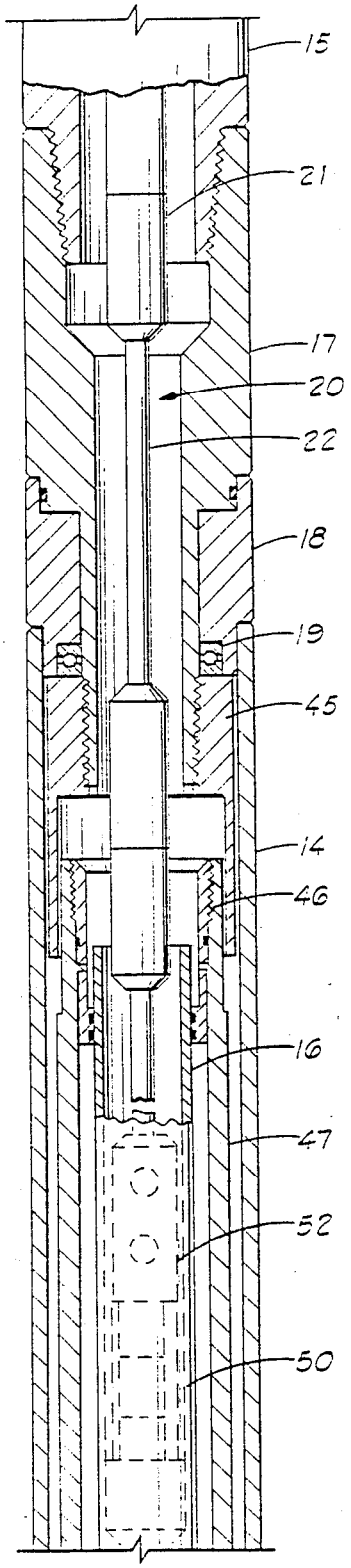
FIG. 2 is a section view of a portion of the drill string of FIG. 1, showing flexible spacer bars interconnected with a section of the surveying instrument housing.

Now referring to FIG. 2, a sectional view of a portion of the drill string of FIG. 1 is shown. The flexible drill pipe sections 14 are coupled to rotating drive pipe 15 by rotating clutch sub 17, clutch 18 and bearing 19, as is well known in the art. Coupling 45 is threaded to the rotating clutch sub 17 which, in turn, is threaded with coupling 46 to internal drive shaft 47. The internal drive shaft 47 rotates inside the non-rotating sleeves 14 of the short-radius drilling assembly 10. Also shown in FIG. 2 are spacer bars 20, which include laterally flexible intermediate sections 22 and are coupled together by upset coupling sections 21. The upset end sections 21 slidably fit in the liner 16. Additionally, as shown in FIG. 2, timer 52 is enclosed within battery and timer housing 50.

Figure 3:
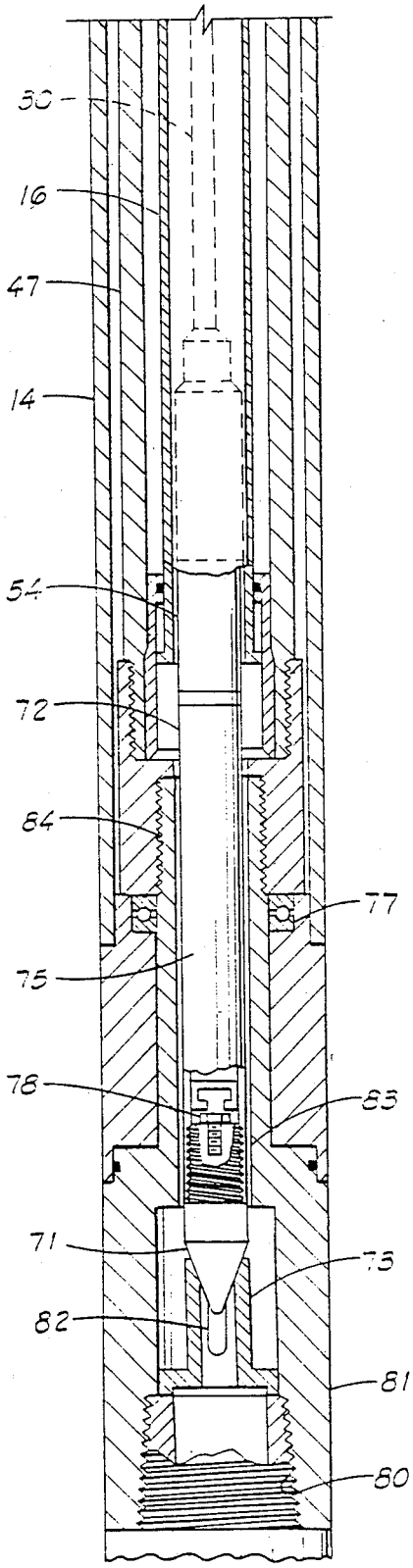
FIG. 3 is a section view of a portion of the drill string of FIG. 1, showing the landing assembly of the surveying instrument assembly positioned at the bottom of a section of a curved drilling guide.
Figure 3:
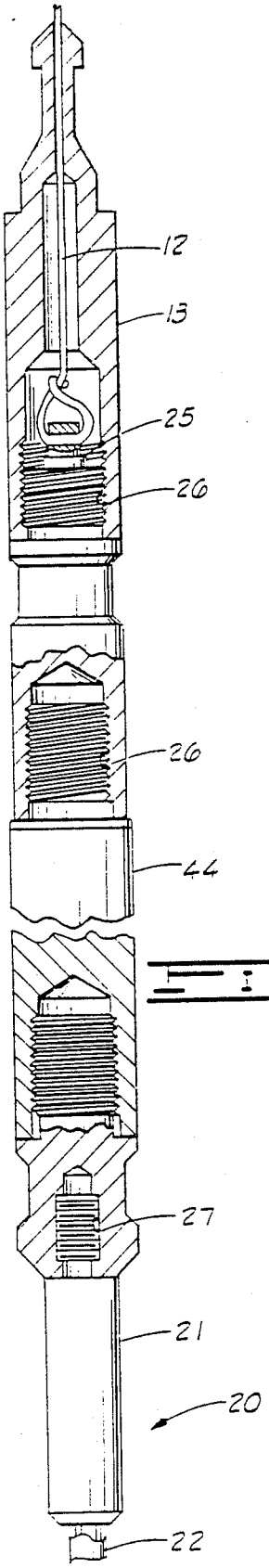

Now referring to FIG. 3, the reduced diameter flexible conductor assembly 30 interconnects the battery and timer housing 50 and the camera and angle unit housing 72. Angle unit assembly 54 and camera 75 are positioned in housing 72 by means known in the art. The camera and angle unit housing 72 is threaded to landing nose assembly 71 with threads 83 and screw 78. The landing nose assembly 71 further includes guiding nose section 82. As shown in FIG. 3, the landing nose assembly 71 is positioned at the landing plate or baffle plate 73 when the surveying instrument assembly reaches the bottom of the wellbore. As is commonly known in the art, shock absorbers (not shown) may be employed to prevent shock loads while running in the hole. Also shown in FIG. 3 are the rotating bit sub 81 and the threaded bit coupling 80. Rotating bit sub 81 is coupled to the internal drive shaft 47 by coupling 84. Also shown in FIG. 3 is bearing 77.

Now referring to FIG. 4, the coupling portion of the flexible conductor assembly 30 is shown in greater detail. The flexible conductor assembly 30 is threadably connected to the camera and angle unit housing 72 with threads 39. The flexible conductor assembly 30 is constructed similarly to spacer rods 20, with the exception that it contains a central longitudinal aperture, in which is disposed conductive rod 31 having an insulator 32. The flexible conductor assembly 30 completes the circuit between the batteries, timer and camera. A telescoping conductive connector 28 is provided at each end of rod 31 for maintaining slidable electrical contact during flexing or bending of the electrical connector assembly. Telescoping connector 28 thereby maintains the circuit with the conductor rod 31 when the flexible instrument assembly flexes within the short-radius drill string. An insulator 33 is provided for the telescoping connector 28. The electrical connections include connector 29, spacer 38, spring 36 and screw 34. Spring 36 is connected to the connector plate 40 and in turn to conductor assembly 41 and contact plate 42. Insulator 43 is between the conductor assembly 41 and the camera and angle unit housing 72. The camera and angle unit housing 72 itself completes the circuit between the batteries, timer and camera. Preferably, the timer, when actuated, will close an internal circuit connecting the negative terminal of batteries 51 with housing 50 to complete an electrical circuit extending from the positive terminals of batteries 51, through conductor 31, the camera within camera and angle unit housing 72, and returning through housing 72, and bar 30 to housing 50.

Figure 5:
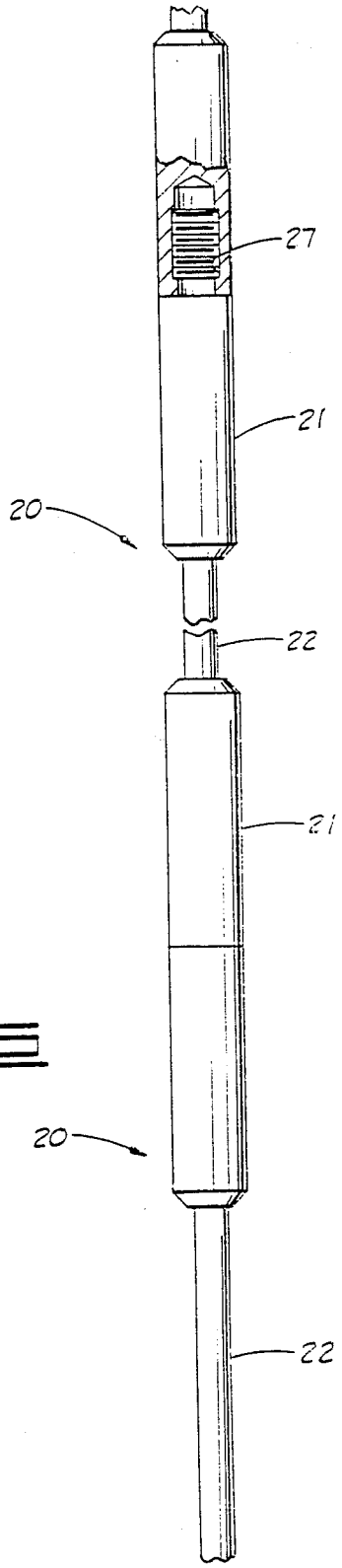
FIG. 5 is a side view, partially in vertical section, of the wireline attachment to the top of the surveying instrument assembly.

Now referring to FIG. 5, the wireline attachment to the surveying instrument assembly is shown, partially in section. Wireline 12 is tied to rope socket 25 of wireline sub 13, which is, in turn, connected to sinker bar 44 by threaded connector 26. Also shown in FIG. 5 is threaded connector 27 which couples flexible spacer bar 20 and sinker bar 44.

As shown in FIG. 6, a plurality of spacer bars 20 having flexible intermediate sections 22 are interconnected by upset coupling sections 21 and threaded connectors 27. The flexible spacer bars assist in positioning the instrument assembly at the optimum point and to negotiate short-radius angles within the wellbore.

Figure 7:
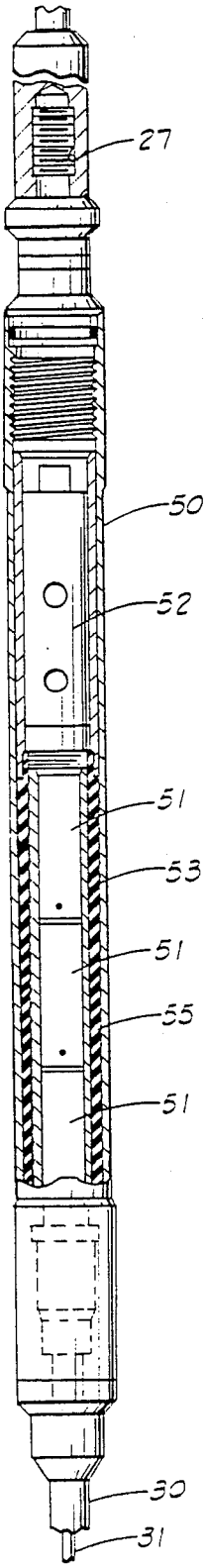
FIG. 7 is a side view, partially in vertical section, of the surveying instrument housing for the remotely actuatable power source.

Now referring to FIG. 7, the battery and timer housing 50 is shown. The battery and timer housing 50 includes one or more batteries 51, battery case 53 and insulator 55. As discussed above, battery and timer housing 50 completes the circuit between the camera, batteries and timer.

Figure 8:
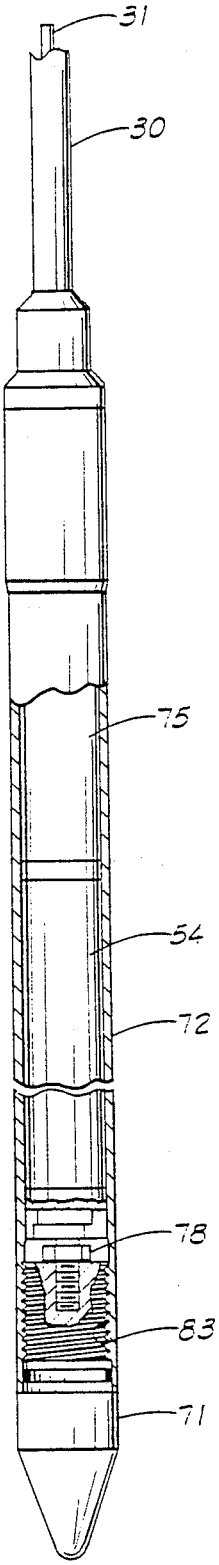
FIG. 8 is a side view, partially in vertical section, of the landing nose assembly and surveying instrument housing for the recording and measuring device of the present invention.

As shown in FIG. 8, the flexible conductor assembly 30 is coupled to camera and angle unit housing 72. The angle unit assembly 54 and camera 75 are enclosed in the housing 72. The angle unit assembly 54 typically includes a compass and inclinometer as are well known to those skilled in the art. Landing nose assembly 71 is threadably connected to the camera and angle unit housing 72 with threads 83 and screw 78.

According to the present invention, housings are provided for the camera and angle unit, and the battery and timer. By placing these components in separate housings, and by coupling them together with a laterally flexible connector, a flexible downhole surveying instrument assembly is achieved. The smaller diameter of the connector and spacer bars allows the assembly to flex in short-radius angle wellbores. This articulated assembly according to the invention also may be advantageously applied for various surveying instrument components used for measuring other parameters, including continuous monitoring and/or solid state devices.

Although variations in the embodiment of the present invention may not each realize all of the advantages of the invention, certain features may become more important than others in various applications of the device. Additional advantages and modifications will be readily apparent to those skilled in the art. The invention in its broader aspects is therefore not limited to the specific details, representative apparatus or the illustrative example shown and described. Accordingly, departures may be made from the detail without departing from the spirit or scope of the disclosed general inventive concept.

What is claimed is:

1. A flexible downhole measuring instrument assembly for use within a wellbore, comprising:

(a) a plurality of instrument components, said components divided into at least two groups;

(b) a plurality of longitudinally separated generally cylindrical housings each enclosing at least one of the groups of instrument components; and (c) a coupling extending longitudinally between and interconnecting said housings, said coupling being laterally flexible but generally longitudinally rigid and including a portion which is smaller in at least one transverse dimension than the diameter of said housings.

2. The flexible downhole measuring instrument assembly of claim 1, further comprising at least one spacer bar associated with and longitudinally connected to the instrument assembly, and wherein the spacer bar further comprises interconnectable end sections and a laterally flexible intermediate section extending longitudinally therebetween.

3. The flexible downhole measuring instrument assembly of claim 2 wherein the intermediate section is generally rigid in axial tension and axial compression, and is smaller in transverse cross-section than the end sections.

4. The flexible downhole measuring instrument assembly of claim 1, wherein the components comprise:

(a) means for measuring parameters concerning the position of the wellbore; and (b) data gathering means for gathering data concerning the measured parameters at a location within the wellbore.

5. The flexible downhole measuring instrument assembly of claim 1, including electrical circuit means extending between said housings comprising:

at least one laterally flexible conductive member positioned within and extending through the laterally flexible coupling and insulated therefrom.

6. A flexible downhole measuring instrument assembly for measuring parameters of a wellbore comprising:

(a) power source components enclosed in a first cylindrical housing slidably receivable within a drill string;

(b) measuring device components enclosed in a second cylindrical housing slidably receivable within a drill string; and (c) a laterally flexible generally cylindrical connector between the first housing and second housing, the connector forming an electrical coupling between the measuring device and the power source, at least a portion of the connector being smaller in diameter than at least one of the first housing or the second housing.

7. The flexible downhole surveying instrument assembly of claim 6, wherein the laterally flexible cylindrical connector comprises:

(a) a laterally flexible conductive member enclosed within the connector for providing a first circuit path;

(b) a conductive end piece coupled to each end of the conductive member and arranged for providing an electrical connection between the conductive member and components within the housings; and (c) a conductive connector body for coupling between the first and second housing to provide a second circuit path.

8. A flexible downhole instrument assembly sized for reception within a short radius directional drill string assembly, comprising:

instrument components for conducting measurements of downhole parameters;

a plurality of housings disposed in mutual longitudinal proximity for enclosing said instrument components, said housings arranged for sliding movement within the drill string assembly; and flexible connector means extending longitudinally between and connected to said housings, said flexible connector means having an intermediate portion which is substantially smaller in transverse cross section than said housings.

9. The instrument assembly of claim 8, wherein said intermediate portion is constructed of a metallic tubular member which is generally rigid on axial tension and axial compression.

10. The instrument assembly of claim 9, wherein said metallic tubular intermediate portion has enlarged end portions formed integral therewith, and means on said end portions for releasably connecting said connector means with said housings.

11. The instrument assembly of claim 10, wherein said enlarged end portions have approximately the same outside diameter as the outside diameter of said housings.

12. The instrument assembly of claim 8, wherein said flexible connector is comprised of upset end portions having approximately the same outside diameter as said housings and said intermediate portion integrally joins said upset end portions.

13. The apparatus of claim 9 and further, including a conductive member positioned within said connector mean for providing at least one circuit path between instrument components, said connector member itself providing another circuit path between instrument components.

14. A downhole instrument assembly for conducting measurements of downhole parameters, said instrument assembly being arranged for insertion within a short radius directional drilling bottom hole assembly in a drill string, including a drill bit, such measurements being sensitive to magnetic materials in the downhole environment, comprising:

cable connector means at the upper end of the instrument assembly for attaching a cable to lower the instrument assembly into the drill string and to retrieve the instrument assembly from the drill string, said connector means being sized for sliding reception within the drill string;

instrument housing means located in the instrument assembly for enclosing instrument components, said housing means being sized for sliding reception within the drill string above the drill bit;

seating means at the lower end of the instrument assembly for seating the instrument assembly within the drill string above the drill bit; and spacer bar means located in the instrument assembly between said cable connector means and said seating mans for positioning said instrument housing means at a predetermined desired location within the drill string above the drill bit, said spacer bar means being constructed of a non magnetic metal which is rigid in axial tension and compression and having upset end portions which are of substantially the same outer diameter as said cable connector means and as said housing means, said upset end portions being joined by a flexible intermediate section which has a substantially smaller outside diameter than said upset end portions for providing sufficient flexibility to the assembly to permit its use within a drill string for drilling short radius directional boreholes.

15. A flexible downhole measuring instrument assembly for use within a wellbore, comprising:

(a) a plurality of instrument components, said components divided into at least two groups;

(b) a plurality of longitudinally separated housings, each enclosing at least one instrument component group;

(c) a laterally flexible coupling extending between and interconnecting said housings; and (d) at least one spacer bar associated with and longitudinally connected to the instrument assembly, said spacer bar including interconnectable end sections and a laterally flexible intermediate section extending longitudinally therebetween.

16. The assembly of claim 15, wherein the intermediate section is generally longitudinally rigid and is smaller in transverse cross-section than the end sections.

* * * * *